US009803636B2

(12) United States Patent
Rothschild et al.

(10) Patent No.: US 9,803,636 B2
(45) Date of Patent: Oct. 31, 2017

(54) STATOR LAMINATE, STATOR ASSEMBLY INCLUDING THE STATOR LAMINATE, AND METHOD OF MAKING THE STATOR ASSEMBLY

(71) Applicant: Penn United Technologies, Inc., Cabot, PA (US)

(72) Inventors: Jesse Benedict Rothschild, St. Francisville, LA (US); Dwight Patrick Jones, Saxonburg, PA (US); Mark Phillip Noah, Butler, PA (US)

(73) Assignee: Penn United Technologies, Inc., Cabot, PA (US)

( * ) Notice: Subject to any disclaimer, the term of this patent is extended or adjusted under 35 U.S.C. 154(b) by 78 days.

(21) Appl. No.: 14/931,885

(22) Filed: Nov. 4, 2015

(65) Prior Publication Data

US 2016/0327037 A1 Nov. 10, 2016

Related U.S. Application Data

(60) Provisional application No. 62/156,512, filed on May 4, 2015.

(51) Int. Cl.

| | |
|---|---|
| ***F01C 1/10*** | (2006.01) |
| ***F01C 5/04*** | (2006.01) |
| ***F04C 18/107*** | (2006.01) |
| ***F04C 2/107*** | (2006.01) |

(52) U.S. Cl.

CPC ..... *F04C 2/1075* (2013.01); *F04C 2240/70* (2013.01)

(58) Field of Classification Search

USPC ..... 418/48, 153, 156, 157

See application file for complete search history.

(56) References Cited

U.S. PATENT DOCUMENTS

| | | | | |
|---|---|---|---|---|
| 1,892,217 | A | 12/1932 | Moineau | |
| 3,975,121 | A | 8/1976 | Tschirky | |
| 4,592,427 | A | 6/1986 | Morgan | |
| 5,755,284 | A | 5/1998 | Hart et al. | |
| 5,832,604 | A * | 11/1998 | Johnson | E21B 4/02 29/447 |
| 7,201,222 | B2 | 4/2007 | Kanady et al. | |
| 7,407,372 | B2 | 8/2008 | Guidry et al. | |
| 8,109,746 | B2 | 2/2012 | Guidry, Jr. | |
| 8,147,228 | B2 | 4/2012 | Guidry, Jr. | |
| 8,215,014 | B2 | 7/2012 | Amburgey | |

(Continued)

OTHER PUBLICATIONS

Penn United Technologies, Inc. PCT/US2015/058921 International Search Report dated Feb. 2, 2016, 14 pages.

*Primary Examiner* — Mark Laurenzi
*Assistant Examiner* — Deming Wan
(74) *Attorney, Agent, or Firm* — Eckert Seamans Cherin & Mellott, LLC; David C. Jenkins

(57) ABSTRACT

A stator assembly for a progressing cavity pump is provided. The stator assembly includes a number of stator laminates having a planar body defining a primary, inner passage and a number of outer passages, the outer passages disposed effectively adjacent the inner passage whereby the inner passage is at least partially defined by a band, wherein the band is outwardly flexible. The stator laminates are coupled to each other in a stack wherein the stator laminate body inner passages define a helical passage. The helical passage is a flexible helical passage.

4 Claims, 6 Drawing Sheets

(56) References Cited

U.S. PATENT DOCUMENTS

| | | | |
|---|---|---|---|
| 8,636,485 | B2 | 1/2014 | Steele |
| 8,905,733 | B2 | 12/2014 | Guidry, Jr. |
| 2013/0149182 | A1 | 6/2013 | Sreshta et al. |

* cited by examiner

STATOR LAMINATE, STATOR ASSEMBLY INCLUDING THE STATOR LAMINATE, AND METHOD OF MAKING THE STATOR ASSEMBLY

CROSS REFERENCE TO RELATED APPLICATION

This application is a continuation-in-part application of and claims priority to U.S. Provisional Patent Application Ser. No. 62/156,512, filed May 4, 2015 entitled, STATOR.

BACKGROUND OF THE INVENTION

Field of the Invention

The disclosed and claimed concept relates to a stator assembly for a progressing cavity pump and, more specifically, to a stator assembly wherein the helical passage is a flexible helical passage.

Background Information

Progressing cavity pumps are often referred to as "Moineau" pumps, in recognition of their inventor, Rene Moineau, who obtained U.S. Pat. No. 1,892,217. Progressing cavity pumps are used in various industries to pump materials such as, but not limited to, viscous fluids, semi-solids, fluids with solids in suspension, and solids. Exemplary materials transported by a progressing cavity pump include, but are not limited to, oil, sewage, fracking fluids or the like. Generally, a progressing cavity pump (also known as a helical gear pump) includes an elongated rotor having one or more externally threaded helical lobes, or "splines," rotatably disposed in a stator assembly or stator body defining a helical passage. In one embodiment, the helical passage includes one more lobes than the helical rotor. The elongated helical passage includes a plurality of helical grooves that form a plurality of cavities with the stator. As the rotor turns within the stator, the cavities progress from a suction end of the pump to a discharge end. In other embodiments, there are an equal number of rotor splines and stator lobes, but the rotor splines are sized and shaped so as to define cavities within the stator lobes. In an exemplary embodiment, each lobe of the rotor is, in theory, constantly in general contact with the stator at any transverse cross section; this has the effect of creating a plurality of empty spaces between the stator and the rotor. It is noted that the clearance, or interference, at a location wherein a rotor spline is not fully seated in a stator lobe, may be variable, i.e., less than substantial engagement. That is, for example, in an embodiment wherein a stator passage has an arcuate end surface and a linear lateral surface, it is desirable to ensure the rotor seals against the arcuate end surface of the stator; this ensures the cavity, and therefore the fluid therein, moves forward. It is desirable, but less important, that the rotor seals against the linear lateral surface of the stator.

As the rotor rotates, the empty spaces advance from the suction end of the helical passage to the discharge end of the helical passage. Further, the empty spaces are isolated from each other by the points of contact between the rotor and the stator, which are often referred to as "seal lines." As the rotor rotates within the stator, the empty spaces "move" or progress with a helical motion along the length of the helical passage. In operation of a progressing cavity pump, the empty spaces are filled with a material that is to be moved. Thus, as the empty spaces progress, the material is moved from one end of the stator to the other end of the stator as the rotor rotates relative to the stator. Due to the shape and geometry of the stator and the rotor, the rotor will move laterally or precess relative to the stator as the rotor rotates within the stator. In other words, the rotor moves eccentrically relative to the stator in addition to rotating within the stator.

In an exemplary embodiment, shown in FIG. 1, a progressing cavity pump 1, includes an elongated helical rotor 2, and a stator assembly 3 defining an elongated helical passage 4. In the exemplary embodiment shown, the rotor has a single lobe and, therefore, has a generally circular cross-sectional shape. The helical passage (shown in cross-section) has an obround shape. As used herein, an "obround" shape includes opposed generally arcuate surfaces and opposed generally parallel, generally linear surfaces; what may be colloquially identified as a "pill" shape. In operation, the rotor 2 reciprocates between the two ends of the helical passage.

To ensure that the rotor is "constantly in substantial contact with the stator at any transverse cross section" the stator helical passage is typically lined with a resilient material, such as but not limited to an elastomeric material. That is, in an exemplary embodiment, the stator assembly includes a rigid support assembly defining the helical passage and the liner is disposed thereon. As the rotor rotates and reciprocates between the two ends of the helical passage, in the exemplary embodiment shown in FIG. 1, the resilient material is compressed between the rotor and the support structure. Further, if the material being moved is a fluid with suspended solids, the solids may pass between the resilient material and the rotor.

This configuration has several disadvantages including the degradable nature of the resilient material liner. That is, the compression of the resilient material liner causes rapid wear and tear on the liner leading to the need for replacement. As used herein, "rapid" degradation is a relative term; a resilient material degrades more rapidly than a durable material. Further, solids passing between the resilient material and the rotor also damage the resilient material liner. Also, the resilient material liner may react with, or be degraded by, the material being moved. Another disadvantage is that rigid stator assemblies are difficult and/or expensive to construct. That is, such stator assemblies are typically created by hydroforming, rolling a metal tube, cold drawing a metal tube, hot extrusion of a metal tube, boring a metal tube using a method such as, but not limited to, electrical discharge machining, and electroforming with metal deposition.

In another embodiment, not shown, the stator assembly is made substantially of a resilient material. While the resilient material may have a rigid outer housing, the helical structure and support is formed by the resilient material. This embodiment also allows for substantial constant contact between the rotor and the stator assembly, and, allows for solids to pass between the rotor and stator. This embodiment is, however, also subject to rapid degradation. Further, as the stator helical passage is generally resilient, the progressing cavity pump of this embodiment is limited to lower pressures and lower transfer speeds. That is, at a higher pressure, the stator will distort allowing back-flow of the material over the rotor.

In another embodiment, not shown, the stator assembly is made of a rigid material with no liner. Typically, both the rotor and the stator are made from a durable material, i.e., a non-resilient material. While a durable material is less subject to wear-and tear, the friction between the two durable material elements will cause wear-and-tear to both the rotor and the stator. Further, with rigid materials forming both the rotor and the stator, particles cannot pass therebetween. That is, a solid trapped between the rigid rotor and stator will be crushed causing additional wear and tear to the components. Alternatively, with a larger or more durable particle, the rotor will flex, possibly bending the rotor permanently. As such, and as used herein, a progressing cavity pump wherein a durable rotor engages, or moves over, a durable stator is a "self-damaging" progressing cavity pump. One solution to the issue with particles in a self-damaging progressing cavity pump is to allow for a small gap between the rotor and the stator; that is, the rotor and stator are not "constantly in contact." This configuration, however, allows for back-flow of the material between adjacent cavities. That is, this configuration is less efficient. Further, in this embodiment, the stator is typically made by one of the expensive methods noted above.

Further, as noted in U.S. Pat. No. 8,905,733 there is an advantage to having turbulent flow of a fluid adjacent the stator surface within a progressing cavity pump. In that patent, the turbulent flow is created or enhanced by grooves in, for example, the surface of the stator helical passage. These grooves, however, must be machined into the stator helical passage surface either during the formation of helical passage or sometime thereafter. As such, the grooves are expensive to incorporate into the stator.

It is understood that a progressing cavity pump includes a drive assembly with a drive shaft that causes the rotor to rotate within the stator thereby creating the pump action. That is, a rotary motion is converted to a fluid action, i.e., pumping. As is known, however, the rotor/stator assembly with minor geometric differences may have a fluid pumped therethrough thereby causing the rotor to rotate. That action is then transferred to the drive shaft and drive assembly. That is, a fluid motion is converted into a mechanical motion. Thus, it is understood that while the following discussion addresses a rotor/stator assembly as a pump, the same rotor/stator assembly may be used to create a rotational motion, i.e., may be used as a drive device, e.g., for a drill.

There is, therefore, the need for an improved progressing cavity pump wherein the components are not subject to rapid degradation, are not self-damaging, and do not allow for back flow of the material being transported.

SUMMARY OF THE INVENTION

These needs, and others, are met by the disclosed and claimed concept which provides for a stator assembly for a progressing cavity pump, including a number of stator laminates having a planar body defining a primary, inner passage and a number of outer passages, the outer passages disposed effectively adjacent the inner passage whereby the inner passage is at least partially defined by a band, wherein the band is outwardly flexible. The stator laminates are coupled to each other in a stack wherein the stator laminate body inner passages define a helical passage. The helical passage is a flexible helical passage.

It is noted that the configuration set forth below, including the selection of the materials, solve the stated problems.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
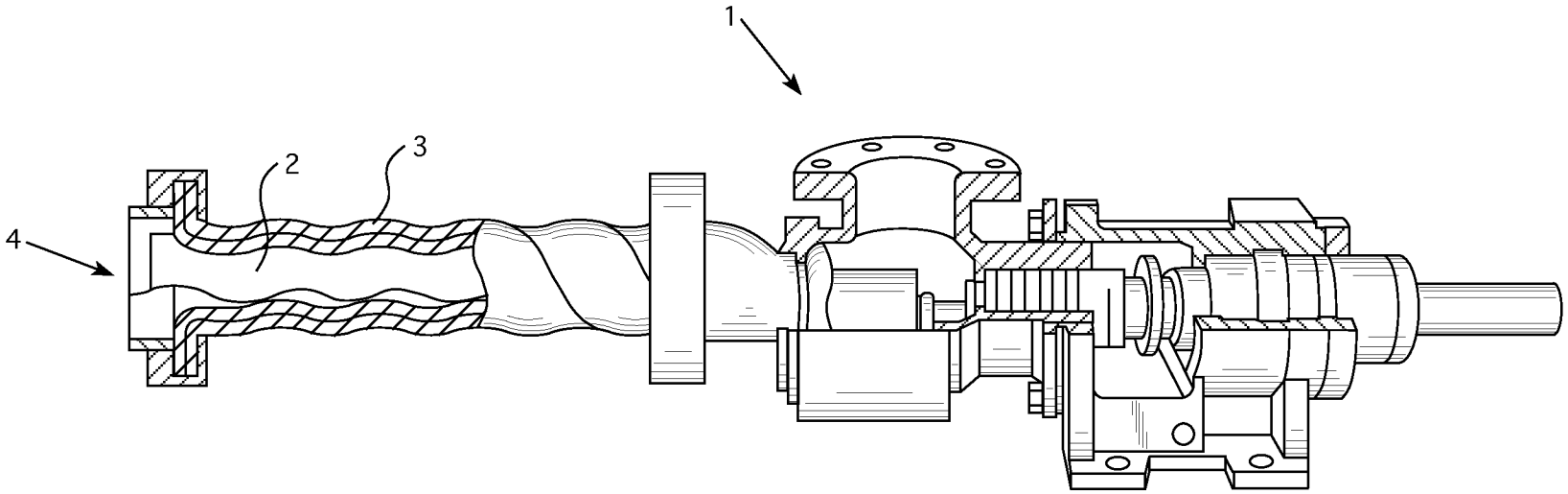
FIG. 1 Prior Art
FIG. 1 is a partial cross-sectional side view of a prior art progressing cavity pump.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. It is noted that moving parts, such as but not limited to circuit breaker contacts, are "directly coupled" when in one position, e.g., the closed, second position, but are not "directly coupled" when in the open, first position. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof.

As used herein, the phrase "removably coupled" means that one component is coupled with another component in an essentially temporary manner. That is, the two components are coupled in such a way that the joining or separation of the components is easy and would not damage the components. For example, two components secured to each other with a limited number of readily accessible fasteners are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As used herein, and in the phrase "[x (a first element)] moves between a first position and a second position corresponding to [y (a second element)] first and second positions," wherein "[x]" and "[y]" are elements or assemblies, the word "correspond" means that when element [x] is in the first position, element [y] is in the first position, and, when element [x] is in the second position, element [y] is in the second position. It is noted that "correspond" relates to the final positions and does not mean the elements must move at the same rate or simultaneously. That is, for example, a hubcap and the wheel to which it is attached rotate in a corresponding manner. Conversely, a spring biased latched member and a latch release move at different rates. Thus, as stated above, "corresponding" positions mean that the elements are in the identified first positions at the same time, and, in the identified second positions at the same time.

As used herein, the statement that two or more parts or components "engage" one another shall mean that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

Further, as used herein, a moving element, or a surface on a moving element, may "generally engage" another element over the path of travel, or, may "substantially engage" another element over the path of travel. As used herein, "generally engage" means that, over the path of travel, the moving element, or a surface on a moving element, generally exerts a force or bias against the other element, but there are points over the path of travel, or points along the surface, that do not exert a force or bias against the other element. As used herein, "substantially engage" means that, over the path of travel, the moving element, or a surface on a moving element, substantially exerts a force or bias against the other element without any significant points over the path of travel, or points along the surface, that do not exert a force or bias against the other element.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate.

As used herein, the word "unitary" means a component that is created as a single piece or unit. That is, a component that includes pieces that are created separately and then coupled together as a unit is not a "unitary" component or body.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, a "planar body" or "planar member" is a generally thin element including opposed, wide, generally parallel surfaces as well as a thinner edge surface extending between the wide parallel surfaces. The perimeter, and therefore the edge surface, may include generally straight portions, e.g., as on a rectangular planar member, or be curved, as on a disk, or have any other shape. Further, a "unitary planar member" includes all of a construct generally disposed in a similar plane. That is, for example, a flat single sheet of paper is a single "unitary planar member" and not two or more planar members disposed adjacent to each other. Stated alternately, a "unitary planar member" extends between the edges of a generally planar construct and is not a portion thereof.

Thus, as used herein, in a tiered construct, including a unitary body tiered construct, each tier is a "planar member" wherein the planar members are divided by a plane(s) extending generally parallel to the flat surfaces of the planar members. That is, each "planar member" is that portion of the construct between the edges of a tier.

As used herein, "about" used in the context of "disposed about [an element or axis]" or "extend about [an element or axis]" means encircle or extend around.

As used herein, "resilient" means flexible and deformable, and does not mean strong.

As used herein, an interface between two surfaces, a rotor assembly outer surface, a slider body edge surface(s), a stator assembly/body helical passage, or stator laminate body inner passage may be identified by one or two adjectives; i.e., a [first adjective], [second adjective] stator assembly/body inner helical passage, or, a [first adjective], [second adjective] stator laminate body inner passage. The adjectives describe the characteristics of at least one surface at the interface, the stator assembly/body inner helical passage surface, or stator laminate body inner passage surface. The first adjective is optional and describes the durability of the material, i.e., a material characteristic. The first adjective is selected from the group consisting of "durable," "robust," and "degradable." The second adjective describes the configuration of the stator assembly, i.e., a configuration characteristic. The second adjective is selected from the group consisting of "rigid," "flexible," "deformable," and "resilient."

As used herein, a "durable" material is a hard metal, alloy or other composition having characteristics similar to a hard metal such as, but not limited to: steel, carbon steel, tool steel, TEFLON® fluorinated hydrocarbons and polymers sold by E.I. duPont de Nemours and Company, A2 tool steel, 17-4 PH stainless steel, crucible steel, 4150 steel, 4140 steel or 1018 steel, polished stainless steel or nearly any stainless, carbon or alloy steels. A "durable" material is not easily damaged.

As used herein, a "robust" material is a rigid material that is less hard than a hard metal or "durable" material and includes, but is not limited to, rigid plastics and composites.

As used herein, a "degradable" material is a soft or easily damaged material such as, but not limited to, elastomeric materials. It is understood that "easily damaged" is a relative term used in comparison to a durable material.

As used herein, a "rigid" configuration substantially maintains its shape when subjected to a bias or force; for example, a stator made from hard metal wherein the stator body is thick enough to prevent flexing of the metal is a stator with a "rigid" configuration.

As used herein, a "flexible" configuration allows for a portion of the surface to deflect when subjected to a bias or force and does so without substantially deforming a localized portion of the surface. For example, a hard material supported by a spring provides a "flexible" configuration in that the surface of the hard material does not substantially deform when a bias is applied thereto, but the spring allows the surface to move/deflect. In a configuration wherein a unitary body defines both the surface and the spring, a "flexible" configuration allows for a deflection at the location the bias is applied and a deformation at a location remote from the location the bias is applied, i.e., the spring elements deform but not the surface at the point the bias is applied.

As used herein, a "deformable" configuration substantially maintains its shape while allowing for surface deformations. For example, an elastomeric liner disposed over a rigid metal support provides a "deformable" surface in that the rigid metal support maintains the shape of the liner but the liner allows for localized compression when a bias is applied, i.e., deformation at the location the bias is applied.

As used herein, a "resilient" configuration is flexible and deformable. A stator assembly/body made substantially of an elastomeric material provides a "resilient" surface in that the body is broadly flexible while also allowing localized deformations at the surface when a bias is applied.

Further, as used herein, the specific adjectives for each group, i.e., [first adjective] (a material characteristic) and [second adjective] (a configuration characteristic), are distinct. That is, as used herein, a single material cannot be both "durable" and "robust." Further, a material or configuration identifiable by one adjective is not, as used herein, "capable" of being identified by another adjective. For example, as used herein, a "deformable" configuration is not capable of being a "flexible" configuration; it is only a "deformable" configuration. It is noted that a "degradable" material, such as, but not limited to, an elastomeric material can be configured to be both "flexible" and "deformable" as defined above. As stated in this paragraph, however, a configuration cannot be both "flexible" and "deformable;" this is why a "flexible" and "deformable" configuration has been defined by a separate adjective, "resilient." That is, for example, as used herein a body made of an elastomeric material is identified herein as a "resilient" configuration and is not identified as both a "flexible" and a "deformable" configuration.

Further, the following examples are provided for clarity. An elastomeric liner disposed on a metal support provides a degradable, deformable surface. That is, the surface is easily damaged but cannot be flexed because of the metal support. A surface on a solid steel plate provides a durable, rigid surface. That is, steel is a durable material that substantially maintains its shape because the plate is not flexible or deformable.

A fluid transmission assembly 6 moves a fluid. The fluid transmission assembly 6, in an exemplary embodiment, utilizes a drive assembly 18 to move a fluid and is identified as a progressing cavity pump 10. As noted above, however, a moving fluid may be used to rotate a driven assembly (not shown) which is typically coupled to a drill bit (not shown) and is identified as a hydraulic motor (not shown). The following uses a progressing cavity pump 10 as an example; it is understood, however, that the rotor assembly 20 and the stator assembly 100, discussed below, could also be used with a hydraulic motor.

Figure 2:
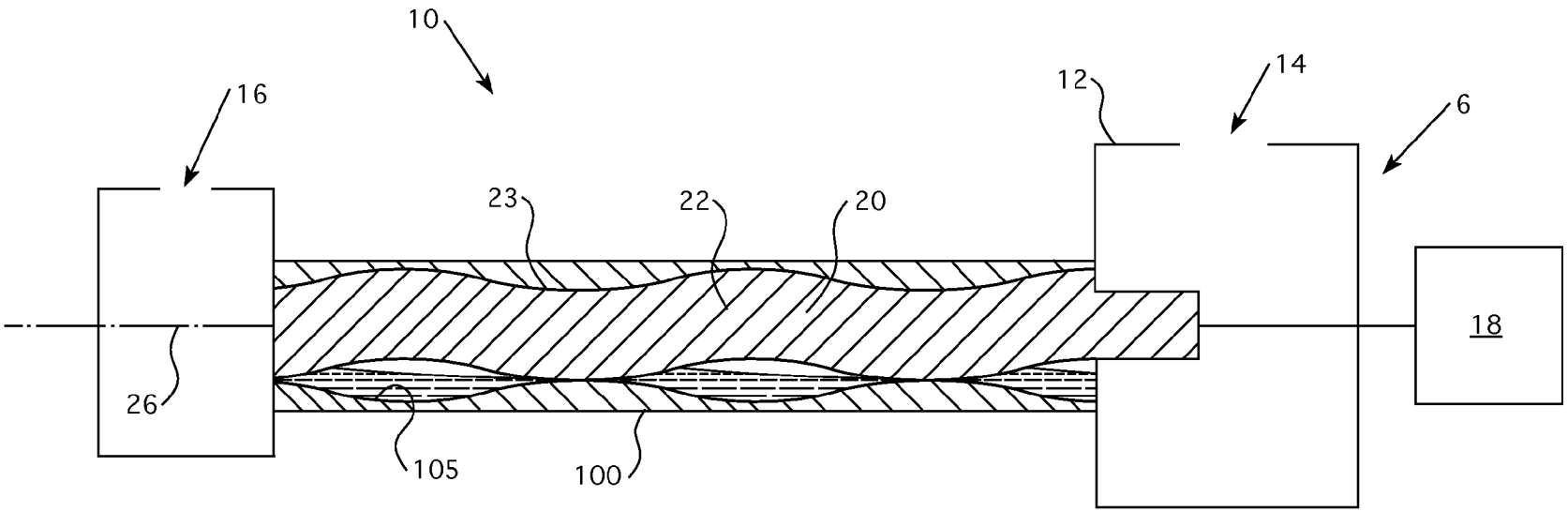
FIG. 2 is a schematic side view of a progressing cavity pump.

FIG. 2 schematically shows a progressing cavity pump 10. As is known, the progressing cavity pump 10 includes a housing assembly 12 defining an inlet 14 and an outlet 16. The progressing cavity pump 10 further includes a drive assembly 18 (which may be remote), a rotor assembly 20, and, a stator assembly 100 that defines an elongated helical passage 104. That is, the stator assembly helical passage 104 is elongated along and is helical about, a longitudinal axis of the stator assembly 100. The helical passage 104 includes a surface 105. Generally, as is known, the inlet 14 and the outlet 16 are both in fluid communication with the stator assembly helical passage 104. The drive assembly 18 is operatively coupled to the rotor assembly 20 and structured to rotate the rotor assembly 20. The rotor assembly 20 is rotatably disposed in the stator assembly helical passage 104. In an exemplary embodiment, the rotor assembly 20 includes an elongated helical body 22 with an outer surface 23. The rotor assembly helical body 22 is sized to contact the stator assembly helical passage 104 along a seal line (not shown). The seal line divides the stator assembly helical passage 104 into separate cavities. Rotation of the rotor assembly helical body 22 causes the cavities to advance from the inlet 14 to the outlet 16, i.e., from, as used herein, an "upstream" location to a "downstream" location. That is, the flow direction "upstream" to "downstream" is in the direction from the inlet 14 to the outlet 16.

In an exemplary embodiment, the rotor assembly outer surface 23 and the stator assembly helical passage surface 105, discussed below, are made from a durable material. Further, at least one of the rotor assembly 20 or the stator assembly 100 includes a flexibility assembly 11. The flexibility assembly 11, as used herein, is structured to provide a flexible surface on at least one of the engagement surfaces of the rotor assembly body 22 or the stator assembly helical passage 104. The "engagement surfaces" as used herein, are the surfaces that meet whereby the stator assembly helical passage 104 is divided into a plurality of cavities. As shown, the "engagement surfaces" are part of either the rotor assembly outer surface 23 or the stator assembly helical passage surface 105.

In an exemplary embodiment, the rotor assembly 20 includes an elongated, helical body 22. In this exemplary embodiment, the rotor assembly body 22 is made from a durable material and is a unitary body. Further, in the embodiment shown, the rotor assembly body 22 includes a single lobe and, as such, has a generally circular cross-sectional shape. It is understood that the rotor assembly body 22 can include any number of lobes wherein each lobe defines an elongated helical portion of the rotor assembly body 22. That is, each lobe defines a helical element disposed about a common longitudinal axis 26. As discussed below, in an exemplary embodiment, the stator assembly helical passage 104 has one more lobes than the rotor assembly body 22. As noted above, however, other embodiments, not shown, include a rotor assembly body 22 wherein the rotor lobes are sized and shaped so as to define cavities within the stator lobes. In the exemplary embodiment shown, the rotor assembly body 22 includes a single lobe; the stator assembly helical passage 104 has two lobes. That is, a two-lobed stator assembly helical passage 104 has an obround cross-sectional shape. Further, in an exemplary embodiment, the rotor assembly body 22 has a generally constant lateral (i.e., perpendicular to the axis of rotation) cross-sectional area from the upstream end to the downstream end. That is, at any selected longitudinal location along the rotor assembly body 22, the rotor assembly body 22 has generally the same cross-sectional area as another selected longitudinal location along the rotor assembly body 22. In an exemplary embodiment, the rotor assembly body 22 substantially engages the arcuate portions of the helical passage 104 while the rotor assembly body 22 generally engages the linear (or non-arcuate) portions of the helical passage 104. That is, the seal in the linear (or non-arcuate) portions of the helical passage 104 is less important than the seal in the arcuate portions of the helical passage 104.

In another exemplary embodiment, the rotor assembly body 22 has a narrowing taper, i.e., a reducing cross-sectional area, from the upstream end to the downstream end. In another exemplary embodiment, the rotor assembly body 22 has a broadening taper, i.e., an increasing cross-sectional area, from the upstream end to the downstream end. It is understood that the stator assembly helical passage 104 cross-sectional area matches the rotor assembly body 22 cross-sectional area, i.e., constant, narrowing, or broadening. The rotor assembly body 22 is coupled, directly coupled, or fixed to the drive assembly 18 and the drive assembly 18 is structured to rotate the rotor assembly body 22.

Figure 3:
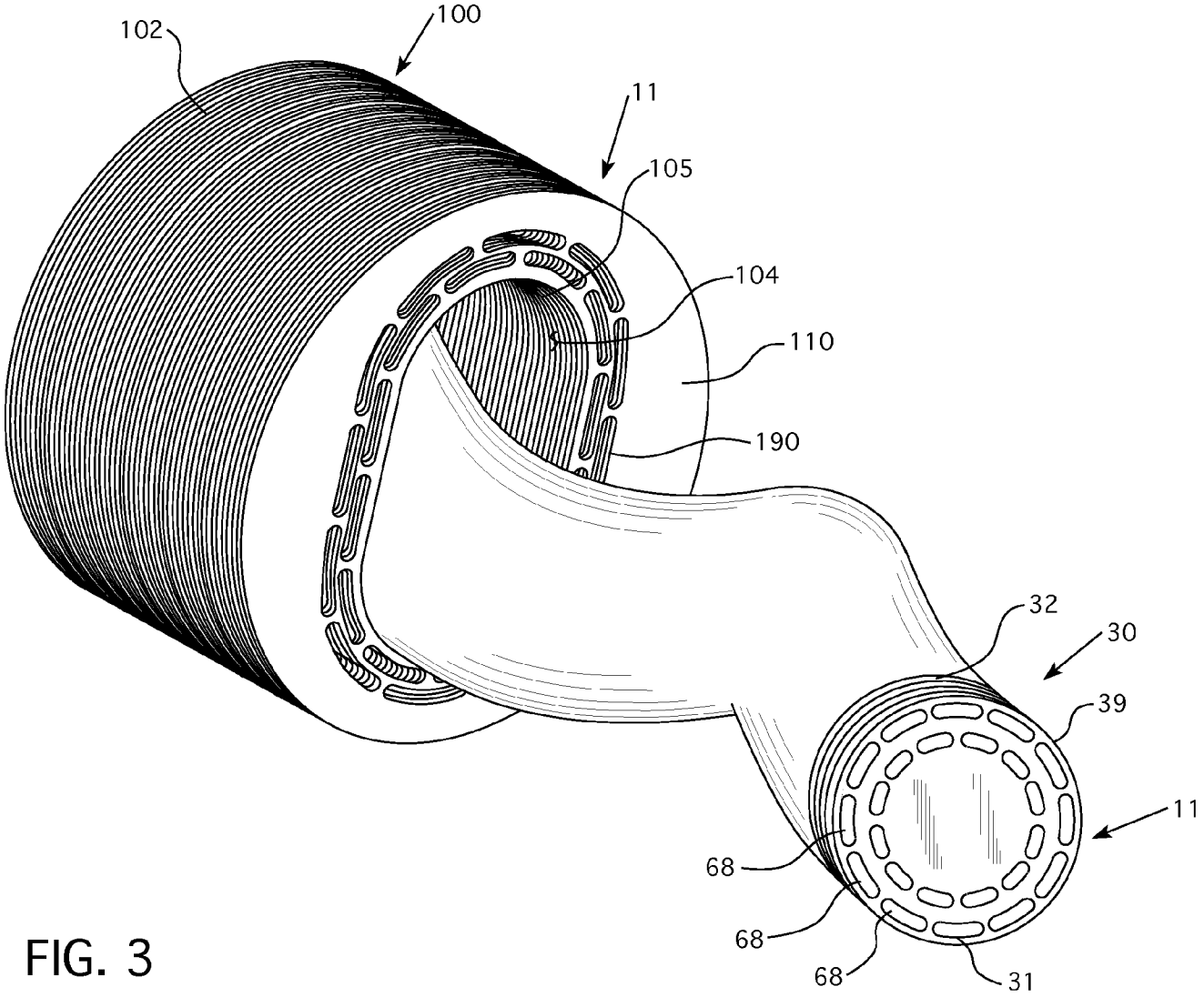
FIG. 3 is an isometric partial view of a rotor assembly and a stator assembly.

In another exemplary embodiment, shown in FIG. 3, the rotor assembly 20 includes a "stacked" body 30. That is, a rotor assembly stacked body 30 includes a "stack" of laminate bodies 32, hereinafter "rotor laminate body 32." As used herein, a "laminate body" or "laminate" is a generally planar body, and in an exemplary embodiment a unitary planar body, having a thickness of between about 0.010 in. and 0.100 in., or about 0.025 in. As used herein, a "stack" or "stacked body" includes a plurality of laminate bodies disposed with one laminate body planar surface against an adjacent laminate body planar surface. Thus, with the exception of the first and last laminate body in the "stack," each laminate body is disposed between two adjacent laminate bodies. The rotor laminate bodies 32 are coupled by any known method including, but not limited to, staking the rotor laminate bodies 32, welding the exterior surface of the rotor laminate bodies 32, welding each rotor laminate body 32 to an adjacent rotor laminate body 32, or mechanically compressing the rotor laminate bodies 32. In this configuration, each rotor laminate body 32 has an edge 34 that extends generally parallel to the axis of rotation of the rotor assembly stacked body 30, i.e., the plane of the rotor laminate body edge 34 extends generally parallel to the axis of rotation of the rotor assembly stacked body 30. As used herein, and with respect to a laminate body, an "edge" includes a surface extending between two generally parallel planar surfaces. Further, as with the unitary rotor assembly body 22 embodiment, the cross-sectional area of the rotor assembly stacked body 30 may be constant, narrowing, or broadening, as described above.

As described below, the stator assembly 100, in one exemplary embodiment, is also a stacked laminate assembly. In an embodiment wherein both the rotor assembly 20 includes a stacked body 30 and the stator assembly 100 includes stator laminate bodies 110, discussed below, each rotor laminate body 32 has a thickness that is substantially the same as the associated stator laminate body 110.

In an exemplary embodiment, each rotor laminate body 32 has a first thickness. That is, each rotor laminate body 32 has a substantially similar thickness. In an alternate embodiment, not shown, rotor laminate bodies 32 have a thickness that may be different from another rotor laminate body 32 thickness. For example, in an exemplary embodiment, not shown, each rotor laminate body 32 in a first set of rotor laminate bodies 32 has a first thickness and each rotor laminate body 32 in a second set of rotor laminate bodies 32 has a second thickness. The sets of rotor laminate bodies 32 may be disposed so that the first set of rotor laminate bodies 32 is upstream of the second set of rotor laminate bodies 32. Alternatively, the first set of rotor laminate bodies 32 may be interleaved with the second set of rotor laminate bodies 32. It is noted that there may be additional sets of rotor laminate bodies 32 with different thicknesses and each set may include any number of rotor laminate bodies 32. In another embodiment, selected sets of laminates may be "thick laminates" as defined below.

Further, in another embodiment, not shown, the rotor laminate bodies 32 may become progressively thicker or thinner. In this embodiment, the rotor laminate bodies 32 may include "thick laminates" which, as used herein, includes a generally planar body, and in an exemplary embodiment a unitary planar body, having a thickness of greater than about 0.010 in. In this embodiment, the thickness of the rotor laminate bodies 32 (which has a thickness that is substantially the same as the associated stator laminate body 110) are thicker at the downstream end of the rotor assembly body 22, wherein a larger cavity within the stator assembly helical passage 104 is defined by a specific number of rotor laminate bodies 32. That is, for example, the size of the cavity defined by ten rotor laminate bodies 32 at the downstream end of the rotor assembly body 22 is larger than the cavity defined by ten rotor laminate bodies 32 at the upstream end of the rotor assembly body 22. In this configuration, the pressure of the fluid being pumped is different at the downstream end of the rotor assembly body 22 relative to the pressure at the upstream end of the rotor assembly body 22.

Figure 4:
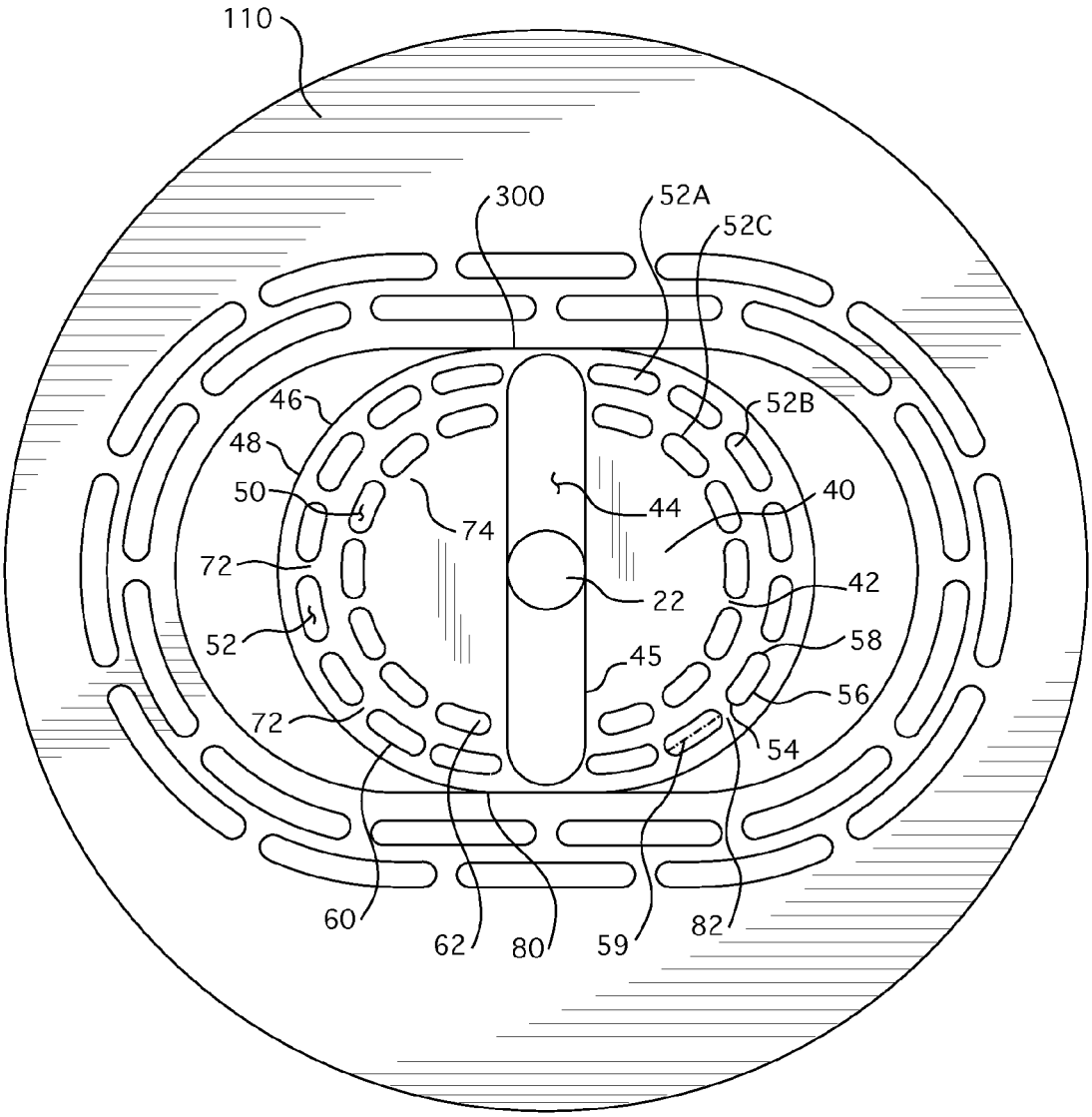
FIG. 4 is a partial front view of a progressing cavity pump rotor assembly and a stator assembly including a slider.

In another exemplary embodiment, shown in FIG. 4, the rotor assembly 20 includes a number of sliders 40, which include a flexibility assembly 11. A slider 40 includes a planar body 42, which is a laminate as defined above, defining an elongated rotor body passage 44 and which has a perimeter 46 and an edge surface 48. In an exemplary embodiment, the slider body 42 is a unitary body. Further, in an exemplary embodiment, each slider body 42 has a thickness that is substantially the same as the associated rotor laminate body 32 and stator laminate body 110. In this embodiment, the slider body edge surface(s) 48 defines the rotor assembly body outer surface 23. As described below, the surface of the rotor body passage 44 defines a cam surface 45. In an exemplary embodiment, wherein the stator assembly helical passage 104 has an obround cross-sectional shape, each slider body 42 has an obround shape that corresponds to the stator assembly helical passage 104 obround shape, but which has a smaller longitudinal length. The longitudinal axis of the rotor body passage 44 is, in an exemplary embodiment, generally perpendicular to the generally parallel, generally linear surfaces of the slider body 42.

It is noted that, in an exemplary embodiment, the engagement of the opposed linear surfaces of the slider body 42 with the opposed linear surfaces of the obround stator assembly helical passage 104, while desirable, is less important than the engagement of the opposed arcuate surfaces of the slider body 42 with the opposed arcuate surfaces of the obround stator assembly helical passage 104. That is, the opposed linear surfaces of the slider body 42 generally engage the opposed linear surfaces of the obround stator assembly helical passage 104 while the opposed arcuate surfaces of the slider body 42 substantially engage the opposed arcuate surfaces of the obround stator assembly helical passage 104.

In an exemplary embodiment, each slider body 42 includes a number of outer passages 50 disposed "effectively adjacent" at least a portion of the slider body perimeter 46 and the slider body edge surface 48. In an exemplary embodiment, the slider body outer passages 50 extend about the slider body perimeter 46 and the slider body edge surface 48. As described below, the slider body outer passages 50 are structured to allow the slider body edge surface 48 to be flexible. Thus, to be disposed "effectively adjacent," as used herein, means that openings are sufficiently close to the perimeter so as to allow the edge surface adjacent the passages to be flexible. It is understood that the distance that is "effectively adjacent" depends on selected variables including, but not limited to, the material characteristics of the slider body 42, the size and shape of the slider body outer passage 50, and the thickness of the slider body 42.

In an exemplary embodiment, a slider body 42 is made from either a durable material or a robust material. Thus, as a non-limiting example, a first slider body (not shown) is made from a durable material and has a thickness of X, and, a second slider body (not shown) is made from a robust material and has a thickness of X/2. Further, on each of the first and second slider bodies the slider body outer passages (not shown) have the same size and shape. In this example, and to be "effectively adjacent," as used herein, the slider body outer passages on the first slider body will need to be closer to the first slider body perimeter (not shown) when compared to the slider body outer passages on the second slider body in order to make the first slider body edge surface (not shown) flexible. That is, it is understood that a durable material is more rigid than a robust material and, as such, in order for the durable material along the first slider body perimeter to become flexible, the first slider body outer passages must be closer to the first slider body perimeter so that the "band," as defined below, is thinner. As is known, a thinner construct is more flexible than a thicker construct of the same material.

In an exemplary embodiment, the slider body outer passages 50 are elongated slots 52 disposed in a concentric configuration. That is, there is a first set of slider body outer passages 60 (i.e., the "first set" is identified collectively by the reference number 60) and a second set of slider body outer passages 62 (i.e., the "second set" is identified collectively by the reference number 62). Each slider body slot 52 is an elongated opening having a first end 54, a medial portion 56, a second end 58 and a longitudinal centerline 59. In an exemplary embodiment, as shown, the slider body slots 52 are generally similar in size, i.e., length along the slider body slot longitudinal centerline 59. The slider body slots 52 generally correspond to the shape of the slider body perimeter 46 adjacent the specific slider body slot 52. That is, in an exemplary embodiment with an obround slider body 42, a slider body slot 52 adjacent the parallel portions of the obround slider body perimeter 46 are generally straight slots 52A. Further, for the reasons stated above, the slider body slots 52 adjacent the parallel portions of the obround slider body perimeter 46 may allow for greater flexibility relative to the generally arcuate slots 52B, discussed below. Conversely, the slider body slot 52 adjacent the arcuate portions of the obround slider body perimeter 46 are generally arcuate slots 52B. A slider body slot 52 that extends over the transition between the parallel portions of the obround slider body perimeter 46 and the arcuate portions of the obround slider body perimeter 46 would have a partially straight and partially arcuate slots 52C.

Further, the slider body slots 52 are, in an exemplary embodiment, "circumferentially adjacent" each other. That is, as used herein, "circumferentially adjacent" means that slots are spaced by a distance that is less than the length along the slot longitudinal centerline. In this configuration, the slots define slider support elements 70 between adjacent slots 52. Stated alternately, the portion of the slider body 42 between slots 52 is defined as a slider support element 70. For clarity, the slider support elements 70 between the slots 52 in the first set of slider body outer passages 60 are identified as slider first supports 72 and the slider support elements 70 between the slots 52 in the second set of slider body outer passages 62 are identified as slider second supports 74.

The first set of slider body outer passages 60 is disposed "effectively adjacent" the slider body perimeter 46. In this configuration, the first set of slider body outer passages 60 defines an outer band 80. That is, as used herein, a "band" is the material of a body that remains after a number of adjacent passages are formed. A "band" is the material disposed between the passages and an adjacent surface, or, the material disposed between concentric sets of passages. Thus, in this configuration, the outer band 80 includes the slider body edge surface 49.

As stated above, in this configuration, each slot 52 is structured to allow the slider body edge surface 49 to be flexible. That is, when a sufficient bias is applied to the slider body edge surface 49 adjacent a slot 52, the outer band 80 defining that portion of the slider body edge surface 49 deflects into the slot 52. It is noted that a portion of the outer band 80 adjacent a slot medial portion 56 is able to flex further than a portion of the outer band 80 adjacent a slot first or second end 54, 58. Moreover, a portion of the outer band 80 adjacent a slider support element 70 will flex only a negligible distance.

Accordingly, the second set of slider body outer passages 62 are disposed effectively adjacent the first set of slider body outer passages 60. That is, the second set of slider body outer passages 62 are disposed about the first set of slider body outer passages 60 and define an inner band 82 therebetween. Further, location of the slider second supports 74 are offset from the location of the slider first supports 72. That is, the slider first supports 72 are disposed at the slot medial portion 56 of a slot 52 in the second set of slider body outer passages 62. In this configuration, when a sufficient bias is applied to the slider body edge surface 49 adjacent a slider first support 72, the inner band 82 adjacent that slider first support 72 will flex into the slot 52 adjacent that slider first support 72. Thus, in an embodiment wherein the slider body outer passages 50 extend about the slider body perimeter 46, there is no portion of the slider body edge surface 49 that is not flexible.

Accordingly, in the configuration described above, the slider body outer passages 50 and slider body bands 80, 82 are the flexibility assembly 11. Thus, when the slider body 42 is made from a durable material, the rotor assembly body outer surface 23 is a durable, flexible rotor assembly body outer surface 23. Alternatively, when the slider body 42 is made from a robust material, the rotor assembly body outer surface 23 is a robust, flexible rotor assembly body outer surface 23.

It is noted that the slots 52, and especially the configuration of the slots 52 shown, are examples only. The slider body outer passages 50 could have any shape including, but not limited to, generally circular openings, generally square openings, generally diamond-shaped openings, generally oval openings, generally triangular openings, generally hexagonal openings, generally octagonal openings, partially radial slots, and spiral slots. Further, a set of outer passages 60, 62 do not have to be a uniform size or shape. That is, a set of outer passages 60, 62 may include any or all of the shapes set forth above. For example, in the configuration described above, the slider support elements 70 could include circular openings. Further, although the slider body outer passages 50, as shown, include generally smooth surfaces, the slider body outer passages 50 may have any shape including shapes with other than smooth surfaces. Further, an outer passage 50, in an exemplary embodiment, not shown, includes internal supports 68. For example, an internal support 68 may be a generally elongated rod or torus disposed within the outer passage 50. The internal supports 68 may be made from the same material as the slider body 42, i.e., the outer passage 50 may be formed in a manner wherein the internal supports 68 are formed as the outer passage 50 are cut out. Alternatively, the internal supports 68 may be made from another material and then coupled, directly coupled, or fixed to the slider body 42. In another exemplary embodiment, the internal supports 68 are springs, not shown.

In another embodiment, shown in FIG. 3, the flexibility assembly 11 in a number of passages 31 is the rotor laminate body 32. That is, the description above with respect to a slider body 42 is also applicable to a rotor laminate body 32. It is understood that the prior seven paragraphs could be rewritten and, generally, by changing the term "slider body" to "rotor laminate body" would describe a flexibility assembly 11 on a rotor laminate body 32. Such a disclosure is incorporated herein by reference. In an exemplary embodiment, each rotor laminate body 32 is a unitary body.

In another embodiment, not shown, the flexibility assembly 11 including outer passages is incorporated into a unitary rotor assembly body 22. That is, a unitary rotor assembly body 22 includes a number of passages (not shown) disposed adjacent the rotor assembly body outer surface 23. The passages are, in an exemplary embodiment, disposed in a configuration similar to the configuration described above, i.e., concentric slots. In this embodiment, the passages are formed in the unitary rotor assembly body 22 by 3D printing, electrical discharge machining, investment casting or any other suitable method.

Figure 5:
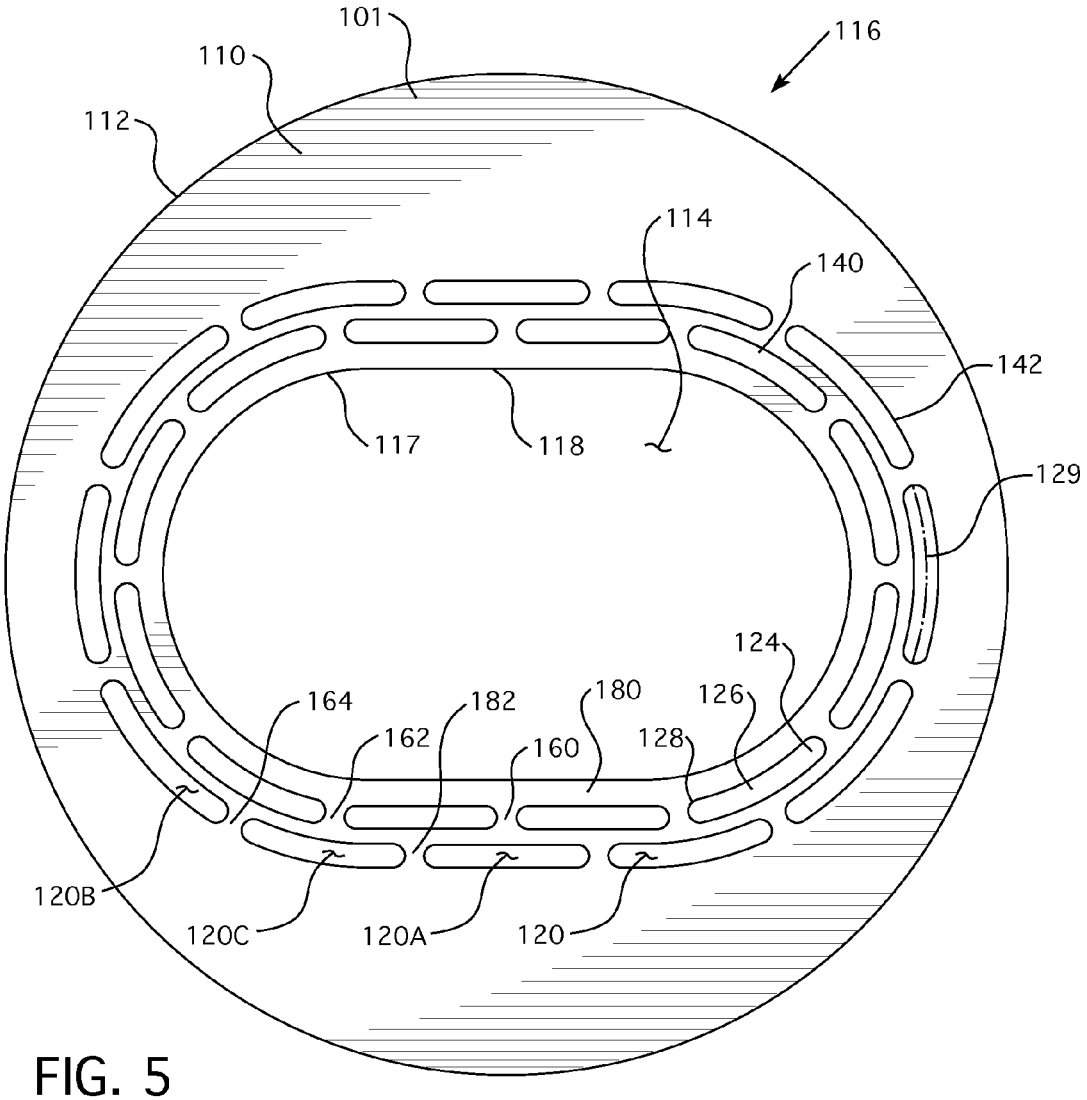
FIG. 5 is a front view of a stator assembly stator laminate body.

As shown in FIG. 5, the stator assembly 100 includes a body 102 defining a helical passage 104. In an exemplary embodiment, stator assembly body 102 is a "stack" of stator laminates 101, i.e., a stack of stator laminate bodies 110. In other exemplary embodiments, not shown but discussed below, stator assembly body 102 is created by traditional methods as noted above. In an exemplary embodiment wherein the stator assembly body 102 is a stack of stator laminates 101, each stator laminate 101 includes a body 110, and in an exemplary embodiment a unitary body. The stator assembly laminate bodies 110 are configured as follows.

As before, a "laminate body" or "laminate" is a generally planar body having a thickness of between about 0.010 in. and 0.100 in., or about 0.025 in. In an exemplary embodiment, a stator assembly laminate body 110 is made from a durable or a robust material. Further, a stator assembly laminate body 110 includes a generally circular outer perimeter 112 and defines a primary, inner passage 114 and a number of outer passages 116. As described below, the stator assembly laminate body inner passage 114 defines the stator assembly helical passage 104, or "helical passage 104." As noted above, in an exemplary embodiment as shown, the helical passage 104 has one more lobe than the rotor assembly body 22; accordingly, in the embodiment shown in FIG. 3 and which is operable with a single-lobed rotor assembly body 22, the stator assembly laminate body inner passage 114 is an obround passage. The stator assembly laminate body inner passage 114 has a perimeter 117 and defines an inner surface 118, which is a planar body edge surface.

In an exemplary embodiment, the stator assembly laminate body outer passages 116 are disposed "effectively adjacent" at least a portion of the stator assembly laminate body inner passage perimeter 117 and the stator assembly laminate body inner passage inner surface 118. In an exemplary embodiment, the stator assembly laminate body outer passages 116 extend about the stator assembly laminate body inner passage perimeter 117 and the stator assembly laminate body inner passage inner surface 118. As described below, the stator assembly laminate body outer passages 116 are structured to allow the stator assembly laminate body inner passage inner surface 118 to be flexible.

In an exemplary embodiment, the stator assembly laminate body outer passages 116 are elongated slots 120 disposed in a concentric configuration. That is, there is a first set of stator assembly laminate body outer passages 140 (i.e., the "first set" is identified collectively by the reference number 140) and a second set of stator assembly laminate body outer passages 142 (i.e., the "second set" is identified collectively by the reference number 142). Each stator assembly laminate body outer passage slot 120 is an elongated opening having a first end 124, a medial portion 126, a second end 128 and a longitudinal centerline 129. In an exemplary embodiment, as shown, the stator assembly laminate body outer passage slots 120 are generally similar in size, i.e., length along the stator assembly laminate body slot longitudinal centerline 129. The stator assembly laminate body outer passage slots 120 generally correspond to the shape of the stator assembly laminate body inner passage perimeter 117 adjacent the specific stator assembly laminate body outer passage slot 120. That is, in an exemplary embodiment with a stator assembly laminate body inner passage 114, a stator assembly laminate body outer passage slot 120 adjacent the parallel portions of the obround stator assembly laminate body inner passage perimeter 117 are generally straight slots 120A. Conversely, a stator assembly laminate body outer passage slot 120 adjacent the arcuate portions of the obround stator assembly laminate body inner passage perimeter 117 are generally arcuate slots 120B. A stator assembly laminate body outer passage slot 120 that extends over the transition between the parallel portions of the obround stator assembly laminate body inner passage perimeter 117 and the arcuate portions of the obround stator assembly laminate body inner passage perimeter 117 would have a partially straight and partially arcuate slots 120C.

Further, the stator assembly laminate body outer passage slots 120 are, in an exemplary embodiment, "circumferentially adjacent" each other. In this configuration, the stator assembly laminate body slots 120 define stator assembly laminate body support elements 160 between adjacent stator assembly laminate body slots 120. Stated alternately, the portion of the stator assembly laminate body 110 between stator assembly laminate body outer passage slots 120 is defined as a stator assembly laminate body support element 160. For clarity, the stator assembly laminate body support elements 160 between the stator assembly laminate body outer passage slots 120 in the first set of stator assembly laminate body outer passages 140 are identified as stator assembly laminate body first support 162 and the stator assembly laminate body support elements 160 between the stator assembly laminate body outer passage slots 120 in the second set of stator assembly laminate body outer passages 142 are identified as stator assembly laminate body second support 164.

The first set of stator assembly laminate body outer passages 140 is disposed "effectively adjacent" the stator assembly laminate body inner passage perimeter 117. In this configuration, the first set of stator assembly laminate body outer passages 140 defines a stator assembly laminate body inner band 180. Thus, in this configuration, the stator assembly laminate body inner band 180 includes the stator assembly laminate body inner passage inner surface 118.

As stated above, in this configuration, each stator assembly laminate body slot 120 is structured to allow the stator assembly laminate body inner passage inner surface 118 to be flexible. That is, when a sufficient bias is applied to the stator assembly laminate body inner passage inner surface 118 adjacent a stator assembly laminate body outer passage slot 120, the stator assembly laminate body inner band 180 defining that portion of the stator assembly laminate body inner passage inner surface 118 deflects into the stator assembly laminate body outer passage slot 120. It is noted that a portion of the stator assembly laminate body inner band 180 adjacent a slot medial portion 56 is able to flex further than a portion of the stator assembly laminate body inner band 180 adjacent a slot first or second end 124, 128. Moreover, a portion of the stator assembly laminate body inner band 180 adjacent a slider support element 70 will flex only a negligible distance.

Accordingly, the second set of stator assembly laminate body outer passages 142 are disposed effectively adjacent the first set of stator assembly laminate body outer passages 140. That is, the second set of stator assembly laminate body outer passages 142 are disposed about the first set of stator assembly laminate body outer passages 140 and define an outer band 182 therebetween. Further, location of the stator assembly laminate body second supports 164 are offset from the location of the stator assembly laminate body first supports 162. That is, the stator assembly laminate body first supports 162 are disposed at the slot medial portion 126 of a stator assembly laminate body outer passage slot 120 in the second set of stator assembly laminate body outer passages 142. In this configuration, when a sufficient bias is applied to the stator assembly laminate body inner passage inner surface 118 adjacent a stator assembly laminate body first support 162, the outer band 182 adjacent that stator assembly laminate body first support 162 will flex into the stator assembly laminate body outer passage slot 120 adjacent that stator assembly laminate body first support 162. Thus, in an embodiment wherein the stator assembly laminate body outer passages 116 extend about the stator assembly laminate body inner passage perimeter 117, there is no portion of the stator assembly laminate body inner passage inner surface 118 that is not flexible.

Accordingly, in the configuration above, the stator assembly laminate body outer passages 116 and the stator assembly laminate body bands 180, 182 comprise the flexibility assembly 11. Stated alternately, the helical passage 104 includes a flexibility assembly 11. Thus, when the stator laminate body 110 is made from a durable material, the stator assembly helical passage surface 105 is a durable, flexible stator assembly helical passage surface 105, and, the stator assembly laminate body inner passage 114 is a durable, flexible stator assembly laminate body inner passage 114. Alternatively, when the stator laminate body 110 is made from a robust material, the stator assembly helical passage surface 105 is a robust, flexible stator assembly helical passage surface 105, and, the stator assembly laminate body inner passage 114 is a robust, flexible stator assembly laminate body inner passage 114.

It is noted that the stator assembly laminate body outer passage slots 120, and especially the configuration of the stator assembly laminate body outer passage slots 120 shown, are examples only. The stator assembly laminate body outer passages 116 could have any shape including, but not limited to, generally circular openings, generally square openings, generally diamond-shaped openings, generally oval openings, generally triangular openings, generally hexagonal openings, generally octagonal openings, partially radial slots, and spiral slots. Further, a set of outer passages do not have to be a uniform size or shape. That is, a set of outer passages may include any or all of the shapes set forth above. For example, in the configuration described above, the stator assembly laminate body support element 160 could include circular openings. Further, although the stator assembly laminate body outer passages 116, as shown, include generally smooth surfaces, the stator assembly laminate body outer passages 116 may have any shape including shapes with other than smooth surfaces. The stator assembly laminate body outer passages 116 may also include internal supports, as described above, not shown.

In another embodiment, not shown, the flexibility assembly 11 including outer passages is incorporated into a unitary stator assembly body (not shown). That is, a unitary stator assembly body includes a number of passages (not shown) disposed adjacent a stator assembly primary, inner passage (not shown). The passages are, in an exemplary embodiment, disposed in a configuration similar to the configuration described above, i.e., concentric slots. In this embodiment, the passages are formed in the unitary stator assembly body by 3D printing, electrical discharge machining, investment casting or any other suitable method.

Figure 6:
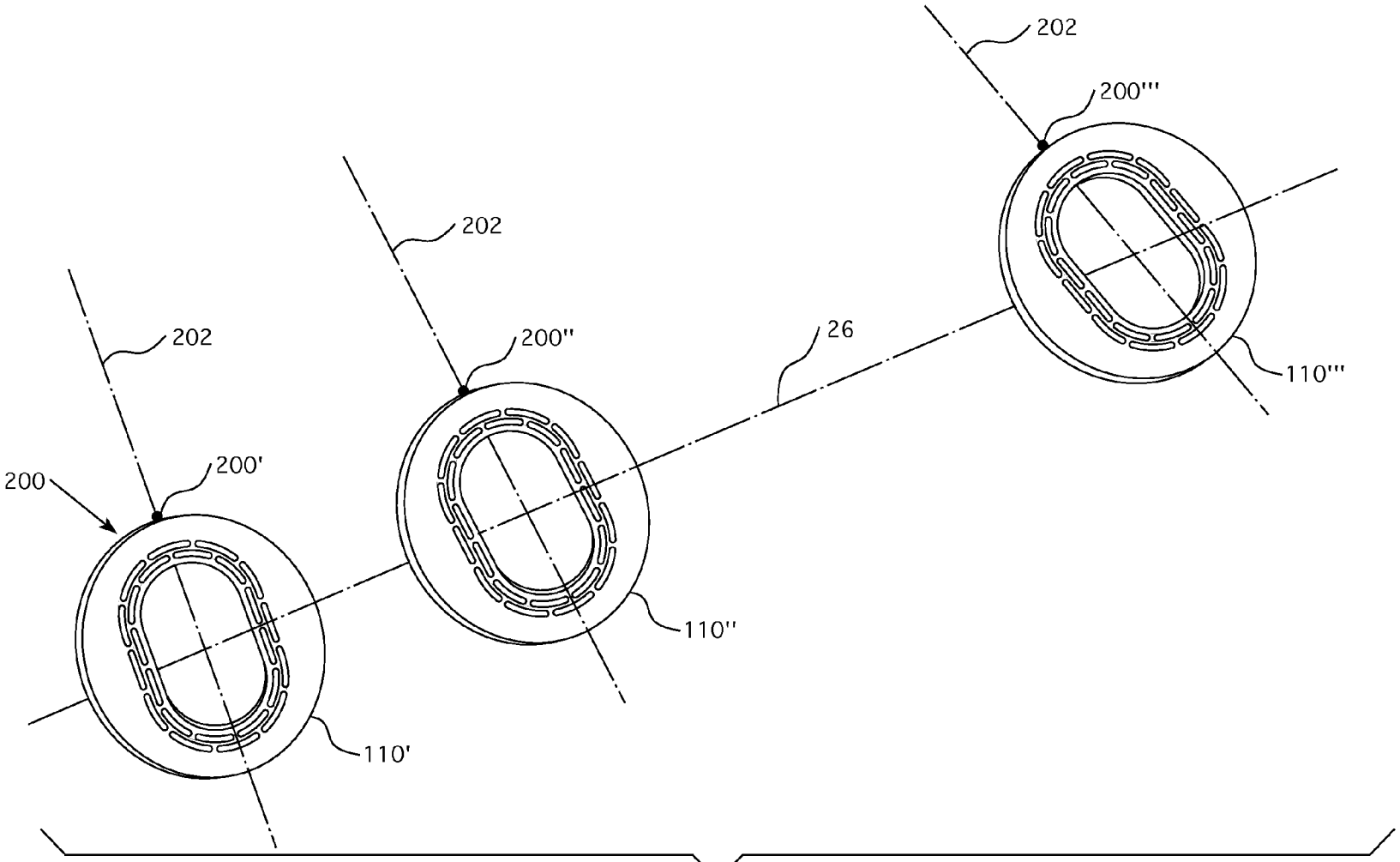
FIG. 6 is an exploded isometric partial view of a stator assembly stator laminate stack.

The stator assembly laminate bodies 110 are assembled into a stator assembly body 102. Generally, the stator assembly laminate bodies 110 are assembled into a stacked body and coupled as described above. To form the helical passage 104, however, each stator assembly laminate body 110 is angularly offset, i.e., rotated slightly relative to an adjacent stator assembly laminate body 110, as shown in FIG. 6. That is, each stator assembly laminate body 110 includes a first reference location 200; as shown, the stator assembly laminate body first reference location 200 is disposed along a longitudinal axis 202 of the stator assembly laminate body inner passage 114. Thus, if a first stator assembly laminate body 110' is oriented with the stator assembly laminate body first reference location 200' at a vertical location, a second stator assembly laminate body 110" is oriented with the stator assembly laminate body first reference location 200' at location radially offset from the vertical location. Similarly, a third stator assembly laminate body 110''' is oriented with the stator assembly laminate body first reference location 200' at location radially offset from the second stator assembly laminate body first reference location 200". It is understood that the radial offset between stator assembly laminate bodies 110 is substantially uniform. By way of example, if helical passage 104 extends over an arc of ninety degrees and the stator assembly body 102 is made from ninety stator assembly laminate bodies 110, each stator assembly laminate body 110 would be radially offset by about one degree from each adjacent stator assembly laminate body 110.

Further, in this configuration, the stator assembly laminate body outer passages 116 also form elongated helical passages, hereinafter "outer helical passages" 190. In one exemplary embodiment, outer helical passages 190 are filled with a resilient material not shown. In this embodiment, the resilient material adheres to the stator assembly laminate body 110. Thus, if during operation of the progressing cavity pump 10 a portion of the stator assembly laminate body inner band 180 broke away from the stator assembly laminate body 110, the resilient material may prevent the broken piece from moving through the stator assembly 100. In another alternative embodiment, a number of the stator assembly laminate bodies 110 at the upstream and downstream ends of the stack are filled with a resilient material (not shown) while the remainder are filled with a dye (not shown) or similar material. In this configuration, the outer helical passages 190 are sealed by the resilient material at the upstream and downstream ends. Further, in the event a portion of the stator assembly laminate body inner band 180 broke away from the stator assembly laminate body 110, the dye would escape and mix with the material being moved (or a drive fluid) and could be detected by a sensor (not shown), or a user, at a downstream location. Thus, the dye, and the sensor if used, acts as a damage warning system.

In an exemplary embodiment, a unitary rotor assembly body 22 is disposed in the helical passage 104, and the unitary rotor assembly body 22 seals against the helical passage 104 along at least one seal line. That is, at least one location along the perimeter of the unitary rotor assembly body 22 substantially contacts the helical passage 104. This relationship can be visualized at one lateral cross-sectional plane of the unitary rotor assembly body 22 and the helical passage 104. Further, this visualization conveniently corresponds to the interaction between the unitary rotor assembly body 22 and a stator laminate body 110. As noted above, in an exemplary embodiment, the rotor assembly body 22 substantially seals against the arcuate portions of the helical passage 104. The rotor assembly body 22 generally seals against the linear portions of the helical passage 104, but the seal in this area is less important than in the arcuate portions of the helical passage 104.

Thus, in the embodiment shown, the unitary rotor assembly body 22 has a generally circular cross-sectional area. In one exemplary embodiment, the diameter of the unitary rotor assembly body 22 is generally the same as the distance between the parallel sides of the obround helical passage 104. In this configuration, the diameter of the unitary rotor assembly body 22 generally corresponds to the lateral width (i.e., the width between the two generally parallel sides of the obround shape) of the obround helical passage 104. Further, the curvature of the unitary rotor assembly body 22 substantially corresponds to the arcuate portions of the obround helical passage 104. Thus, the unitary rotor assembly body 22 generally engages the obround helical passage 104 at two opposed locations when disposed in the medial portion of the obround helical passage 104, and, substantially engages the arcuate portions of the obround helical passage 104 when disposed at either end of the obround helical passage 104. As the unitary rotor assembly body 22 rotates, the unitary rotor assembly body 22 at a specific lateral plane, as shown, reciprocates within the obround helical passage 104. Thus, generally, the obround helical passage 104 is divided into two cavities; one on either side of the unitary rotor assembly body 22. It is understood that when the unitary rotor assembly body 22 reaches a maximum lateral offset, the unitary rotor assembly body 22 substantially engages one arcuate portion of the obround helical passage 104.

In another embodiment, the obround helical passage 104, or stated alternately, each obround stator assembly laminate body inner passage 114, is slightly smaller than the cross-sectional area of the unitary rotor assembly body 22. This is possible because of the flexibility assembly 11 on the stator assembly laminate bodies 110. That is, each stator assembly laminate body inner passage inner surface 118 snuggly corresponds to the unitary rotor assembly body 22. In this configuration, and as the unitary rotor assembly body 22 reciprocates as described above, the flexibility assembly 11 on the stator assembly laminate body 110 allows each stator assembly laminate body inner passage 114 to expand, i.e., flex, to a slightly larger cross-sectional area sufficient to accommodate the unitary rotor assembly body 22.

In the embodiment described above, the unitary rotor assembly body 22 engages and seals against the helical passage 104 along at least one seal line. A seal line is, almost literally, a line, i.e., a very thin, almost linear interface. It is understood that in the physical world, no interface exists literally along a two-dimensional line. If there were, for example, a scratch on the stator assembly helical passage surface 105, the seal line could not engage the surface of the scratch and, therefore, would not seal the cavities as described above. An embodiment wherein the rotor assembly 20 includes a rotor assembly stacked body 30, the rotor laminate bodies 32 edge surfaces extend in a direction generally parallel to the rotor assembly 20 axis of rotation. Similarly, each stator assembly laminate body inner passage inner surface 118 extends in a direction generally parallel to the rotor assembly 20 axis of rotation In an embodiment with a rotor assembly stacked body 30, each rotor laminate body 32 is disposed within a single stator assembly laminate body inner passage 114, i.e., within the plane of a single stator assembly laminate body 110. Thus, each rotor laminate body 32 is associated with the stator assembly laminate body 110 in which it is disposed. As noted above, each rotor laminate body 32 has a thickness that is substantially the same as the associated stator laminate body 110. In this configuration, the abutting rotor laminate bodies 32 edge surface and stator assembly laminate body inner passage inner surface 118 provide a more complete seal than the seal line of the embodiment above. That is, as used herein, a "more complete seal" is a planar sealing area as opposed to a seal line.

Accordingly, in the configuration described above, the progressing cavity pump 10 includes a durable, flexible stator assembly helical passage surface 105, as described above. That is, the progressing cavity pump 10 is structured to provide a flexible surface on at least one of the engagement surfaces of the rotor assembly body 22 or the stator assembly helical passage 104.

In another embodiment, the rotor assembly 20 includes a number of sliders 40 as described above. That is, the rotor assembly 20 includes a unitary rotor assembly body 22 as described above, except the unitary rotor assembly body 22 is sized to fit within the rotor body passage 44 and is not sized to correspond to the width of the obround helical passage 104. As with the rotor laminate bodies 32, each slider body 42 is associated with a single stator assembly laminate body 110 and is disposed within a single stator assembly laminate body inner passage 114, i.e., within the plane of a single stator assembly laminate body 110. Each slider body 42 is further disposed on the unitary rotor assembly body 22. That is, for each slider body 42, the unitary rotor assembly body 22 is disposed in the rotor body passage 44, and, each slider body 42 is movably disposed in an associated stator assembly laminate body inner passage 114, as shown in FIG. 4. In this configuration, when the unitary rotor assembly body 22 rotates, the unitary rotor assembly body 22 operatively engages the rotor body passage cam surface 45 causing the slider body 42 to reciprocate in the associated stator assembly laminate body inner passage 114.

Accordingly, in the configuration described above, the progressing cavity pump 10 includes a durable, flexible rotor assembly outer surface 23. That is, the progressing cavity pump 10 is structured to provide a flexible surface on at least one of the engagement surfaces of the rotor assembly body 22 or the stator assembly helical passage 104. Further, as shown in FIG. 4, the stator assembly helical passage surface 105 also includes a flexibility assembly 11. Thus, both the rotor assembly outer surface 23 and the stator assembly helical passage surface 105 include a flexibility assembly 11. Stated alternately, the interface 300 of the rotor assembly outer surface 23 and the stator assembly helical passage surface 105 is a flexible interface. That is, as used herein, a "flexible interface" is an interface wherein both elements that make the interface have a flexible configuration. Moreover, when both elements that make the interface are made from a durable material, the interface 300 is a durable, flexible interface 300. Alternatively, if both elements that make the interface are made from a robust material, the interface 300 is a robust, flexible interface 300.

It is noted that, in this configuration, the angularly offset stator laminate bodies 110 create a series of steps or tiers within the stator assembly helical passage 104. These steps affect the flow of the material through the stator assembly helical passage 104; that is, the steps create turbulence in the material flow. Accordingly, the steps act as turbulators 170. Further, the turbulators 170 are not machined into the stator laminate bodies 110 or formed by another manufacturing process. As such, the turbulators 170 are "innate turbulators" 170. That is, as used herein, an "innate turbulator" is a turbulator that is formed from the assembly of laminate bodies or a similar construct and is not a turbulator formed by cutting or otherwise forming a groove or channel in a body. It is noted that the rotor assembly stacked body 30 described above also forms innate turbulators.

Accordingly, a method of making a rotor assembly 20 includes the following. Providing 1000 a number of rotor laminate bodies 32, each rotor laminate body 32 including a flexibility assembly 11, and assembling 1002 the rotor laminate bodies 32 into a stack. Providing 1000 a number of rotor laminate bodies 32 includes providing 1010 a laminate material, forming 1012 a rotor laminate body 32 with a number of outer passages disposed effectively adjacent the rotor laminate body edge 34. Providing 1010 a laminate material, forming 1012 a rotor laminate body 32 includes cutting 1020 a rotor laminate body 32 from the laminate material, and cutting 1022 a number of outer passages disposed effectively adjacent the rotor laminate body edge 34. Cutting 1022 a number of outer passages, in an exemplary embodiment, includes cutting 1023 a first set (not shown) of outer passages disposed effectively adjacent the rotor laminate body edge 34 and cutting 1025 a second set (not shown) of outer passages disposed effectively adjacent the first set of outer passages. Assembling 1002 the rotor laminate bodies 32 includes coupling 1060 the rotor laminate bodies 32 and at least one of staking 1062 the rotor laminate bodies 32, welding 1064 the exterior surface of the rotor laminate bodies 32, welding 1066 each rotor laminate body 32 to an adjacent the rotor laminate body 32, or mechanically compressing 1068 rotor laminate bodies 32.

In an alternate embodiment, providing 1000 a number of rotor laminate bodies 32 includes providing 1010 a laminate material, forming 1012 a rotor laminate body 32 and forming 1014 a slider body 42 with a number of outer passages disposed effectively adjacent the slider body edge surface 49 and a rotor body passage 44. Forming 1012 a rotor laminate body 32 from the laminate material includes cutting 1020 a rotor laminate body 32 from the laminate material. Forming 1014 a slider body 42 includes cutting 1026 a slider body 42 from the laminate material, cutting 1028 a number of outer passages 50 disposed effectively adjacent the slider body edge surface 48, and cutting 1030 rotor body passage 44. Cutting 1028 a number of outer passages, in an exemplary embodiment, includes cutting 1027 a first set 60 of outer passages disposed effectively adjacent the slider body edge surface 49 and cutting 1029 a second set 62 of outer passages disposed effectively adjacent the first set 60 of outer passages. In this embodiment, assembling 1002 the rotor laminate bodies 32 includes staking 1062 the rotor laminate bodies 32, welding 1064 the exterior surface of the rotor laminate bodies 32, welding 1066 each rotor laminate body 32 to an adjacent the rotor laminate body 32 or mechanically compressing 1068 rotor laminate bodies 32. In this embodiment there is also a step of disposing 1070 a slider body 42 on an associated rotor laminate body 32.

Similarly, a method of making a stator assembly 100 includes the following. Providing 1100 a number of stator laminate bodies 102, each stator laminate body 102 including a flexibility assembly 11, and assembling 1102 the stator laminate bodies 102 into a stack. Providing 1100 a number of stator laminate bodies 102 includes providing 1110 a laminate material, forming 1112 a stator laminate body 110 with an inner passage 114 and a number of outer passages 116 disposed effectively adjacent the stator inner passage 114. Providing 1110 a laminate material, forming 1012 a rotor laminate body 32 includes cutting 1120 a stator laminate body 110 from the laminate material, cutting 1122 an inner passage 114, and cutting 1124 a number of outer passages disposed effectively adjacent the adjacent the stator inner passage 114. Cutting 1028 a number of outer passages 116, in an exemplary embodiment, includes cutting 1027 a first set 140 of outer passages disposed effectively adjacent the stator inner passage 114 and cutting 1029 a second set 142 of outer passages 116 disposed effectively adjacent the first set 140 of outer passages 116. Assembling 1102 the stator laminate bodies 110 includes coupling 1160 the stator laminate bodies 110 wherein each stator laminate body 110 is angularly offset from an adjacent stator laminate body 110. Coupling 1160 the stator laminate bodies 110 includes at least one of staking 1162 the stator laminate bodies 110, welding 1164 the exterior surface of the stator laminate bodies 110, welding 1166 each stator laminate body 110 to an adjacent the stator laminate body 110, or mechanically compressing 1168 stator laminate bodies 110. As noted above, this method creates an inner passage 114 that is at least partially defined by a band 180 wherein the band 180 is flexible.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A stator laminate for a progressing cavity pump stator assembly comprising:

a planar body defining a primary, inner passage and a number of outer passages;

said outer passages disposed effectively adjacent said inner passage whereby said inner passage is at least partially defined by a band;

wherein said band and outer passages comprise a flexibility assembly: wherein said number of outer passages include circumferentially adjacent passages;

said number of outer passages includes a number of slots;

each of said slot including a first end, a medial portion, and a second end;

and said slots defining a number of support elements between said adjacent slots.

2. The stator laminate of claim 1 wherein said number of outer passages are disposed about said inner passage.

3. The stator laminate of claim 2 wherein:

said number of outer passages includes a first set of outer passages and a second set of outer passages;

said first set of outer passages are disposed about said inner passage;

said first set of outer passages defining a number of first support elements between adjacent passages;

said second set of outer passages are disposed about said first set of outer passages;

said second set of outer passages defining a number of second support elements between adjacent passages.

4. A stator assembly for a progressing cavity pump, said progressing cavity pump including an elongated helical rotor, said stator assembly comprising:

a number of stator laminate bodies, each of said stator laminate body is planar defining a primary, inner passage and a number of outer passages, said outer passages disposed effectively adjacent said inner passage whereby said inner passage is at least partially defined by a band, wherein said band is flexible;

said stator laminate bodies coupled to each other in a stack wherein said stator laminate body inner passages define a helical passage and said stator laminate body outer passages define helical outer passages;

wherein said helical passage includes a flexibility assembly;

each said stator laminate body number of outer passages includes a first set of outer passages and a second set of outer passages;

said first set of outer passages are disposed about the associated inner passage; and said second set of outer passages are disposed about the associated first set of outer passages.

* * * * *